US008573874B2

(12) United States Patent
Neuner

(10) Patent No.: US 8,573,874 B2
(45) Date of Patent: Nov. 5, 2013

(54) METAL CLAD CERAMIC COSMETIC APPLICATOR

(75) Inventor: Charles P. Neuner, Amityville, NY (US)

(73) Assignee: ELC Management, LLC, New York, NY (US)

( * ) Notice: Subject to any disclaimer, the term of this patent is extended or adjusted under 35 U.S.C. 154(b) by 549 days.

(21) Appl. No.: 12/765,061

(22) Filed: Apr. 22, 2010

(65) Prior Publication Data

US 2011/0103879 A1 May 5, 2011

Related U.S. Application Data

(60) Provisional application No. 61/184,246, filed on Jun. 4, 2009.

(51) Int. Cl.
*B43K 1/06* (2006.01)

(52) U.S. Cl.
USPC ..... 401/261; 401/265

(58) Field of Classification Search
USPC ..... 401/21, 261, 265
See application file for complete search history.

(56) References Cited

U.S. PATENT DOCUMENTS

| | | | |
|---|---|---|---|
| 2,298,157 | A | 10/1942 | Phillips |
| 3,752,155 | A | 8/1973 | Blinoff, Jr. et al. |
| 4,925,327 | A | 5/1990 | Wirt |
| 6,234,698 | B1 | 5/2001 | De Laforcade |
| 6,238,117 | B1 | 5/2001 | Griebel et al. |
| 2001/0033766 | A1 | 10/2001 | Gueret |

(Continued)

FOREIGN PATENT DOCUMENTS

| | | |
|---|---|---|
| EP | 0475426 | 3/1992 |
| EP | 1155635 | 11/2001 |

(Continued)

OTHER PUBLICATIONS

PCT International Search Report; International Application No. PCT/US2010/031983; Completion Date: Dec. 28, 2010; Date of Mailing: Dec. 29, 2010.

(Continued)

*Primary Examiner* — David Walczak
*Assistant Examiner* — Joshua Wiljanen
(74) *Attorney, Agent, or Firm* — Martin W. Haerter

(57) ABSTRACT

A cosmetic applicator formed from ceramic material covered in a metal sheath. The tip is designed to provide a product chilling effect when applying creams, lotions, treatment products, etc. The applicator is provided with a relatively substantial mass of ceramic material so that it has a greater thermal capacity than the dose of cosmetic and the application area combined. The applicator is in the form of a molded-ceramic applicator head or applicator tip sheathed, coated or plated in metal. The tip provides a relatively larger product-chilling effect to both the dose of cosmetic applied and to the user's skin in the application area when applying creams, lotions, treatment products, etc. The applicator provides an application device which will deliver the creams, lotions, treatment products, etc. such that the temperature of the product being delivered is lower than the temperature of the skin, and to provide a means of lowering the temperature of the skin by virtue of the thermal absorption capacity of the applicator head or tip, and to provide a vehicle by which formulations may be activated or enhanced by specific compounds in the ceramic material from which the applicator tip is comprised.

20 Claims, 4 Drawing Sheets

(56) References Cited

U.S. PATENT DOCUMENTS

| | | | | |
|---|---|---|---|---|
| 2002/0021932 | A1 | 2/2002 | Gueret | |
| 2003/0063945 | A1 | 4/2003 | Gueret | |
| 2003/0086742 | A1 | 5/2003 | Gueret | |
| 2004/0234321 | A1 * | 11/2004 | Breidenbach et al. | 401/21 |
| 2005/0258172 | A1 | 11/2005 | Gueret | |
| 2007/0186951 | A1 | 8/2007 | Gueret | |
| 2007/0206986 | A1 | 9/2007 | Gueret | |
| 2008/0142036 | A1 | 6/2008 | Sanchez | |
| 2008/0279616 | A1 | 11/2008 | Thorpe | |
| 2011/0123252 | A1 | 5/2011 | Thorpe | |

FOREIGN PATENT DOCUMENTS

| | | |
|---|---|---|
| EP | 1417909 | 5/2004 |
| GB | 2449141 | 11/2008 |
| JP | 2003-205008 | 7/2003 |
| JP | 2005-319300 | 11/2005 |
| JP | 2007-181668 | 7/2007 |
| JP | 2009-039509 | 2/2009 |
| JP | 2009-077878 | 4/2009 |

OTHER PUBLICATIONS

PCT Written Opinion of the International Searching Authority, or the Declaration; International Application No. PCT/US2010/031983; Completion Date: Dec. 28, 2010; Mailing Date: Dec. 29, 2010.

PCT International Search Report; International Application No. PCT/US2010/031973; Completion Date: Dec. 28, 2010; Date of Mailing: Dec. 29, 2010.

PCT Written Opinion of the International Searching Authority, or the Declaration; International Application No. PCT/US2010/031973; Completion Date: Dec. 28, 2010; Mailing Date: Dec. 29, 2010.

Supplementary European Search Report; EP10783751; Completion Date: May 15, 2013; Date of Mailing: May 23, 2013.

* cited by examiner

METAL CLAD CERAMIC COSMETIC APPLICATOR

CROSS-REFERENCE TO RELATED APPLICATIONS

The present application claims priority from U.S. Provisional Application No. 61/184,246, filed Jun. 4, 2009.

FIELD OF THE INVENTION

The present invention is in the field of cosmetic packaging that includes an applicator. More particularly, the present invention is a cosmetic applicator formed from ceramic material clad in metal. The tip is designed to provide a product chilling effect when applying creams, lotions, treatment products, etc.

BACKGROUND OF THE INVENTION

For the convenience of the cosmetic user, cosmetic packaging often includes a cosmetic applicator suitable for dispensing the particular cosmetic contained in the package reservoir. In the case of a jar or vial, the applicator may be a wand with a handle at one end and an applicator head in the form of a brush, spatula or other applicator structure suitable for applying the particular cream, lotion, foundation or color cosmetic. Where the cosmetic container is a bottle or tube, the applicator may be in the form of an applicator tip secured directly to the neck of the bottle or tube, and may additionally be provided with an opening or openings, or a duct or ducts, adapted to expel or express cosmetic product from the container. The applicator head or applicator tip is used to apply and spread the applied product, and may additionally serve to massage the skin of the user in the application area. Applicator heads and applicator tips having a variety of shapes and configurations are known, a number of which are provided with means for heating. Heating the applicator head or applicator tip is said to facilitate treatment and efficacy by, for example, expanding skin pores.

Applicators used in combination with heat are disclosed for example in patents, such as, U.S. Pat. No. 2,298,157 to Phillips or U.S. Publn. No. 2007/0206986 to Gueret.

It is also believed that cooling certain skin conditions can have a beneficial effect. For example, cooling the skin area below the eyes has been shown to reduce puffiness. In the past such cooling has been accomplished with, for example, chilled cucumber slices, pre-chilled treatment creams or lotions, or chilled washcloths or cleansing pads.

Prior art packages with applicator heads or applicator tips including glass or metal components have been used to provide some chilling effects to the package, but the effectiveness has generally been limited by the relatively small thermal mass of the components and by other limitations. Glass, for example, may shatter when dropped. Some types of metal may oxidize which in turn may cause discoloration of the cosmetic product. Other more suitable metals such as silver or gold are too expensive for use in most cosmetic applicators in any great quantity. Both solid metal and glass present challenges with respect to cost effective manufacture of complex shapes, structural and surface details.

Also, materials previously used to provide a chilling effect in current applications of comparable designs (metal, glass, etc.) are difficult or impossible to mold with sufficiently-fine details, such as, small orifices or passages for product delivery. Glass or metal materials may require a secondary operation to form fine details such as a product delivery orifice or product delivery passage or duct, and due to manufacturing constraints the details are generally larger than desired. With respect to an orifice or a passage, this may require, for example, lining the orifice or passage with a secondary material (e.g., plastic or rubber) which may not have ideal thermal capacity or transfer characteristics or cosmetic product compatibility. Thus, product is delivered, for example, at a less than optimal temperature, i.e., not sufficiently chilled.

Accordingly there is a need for an applicator head or applicator tip that provides a relatively large thermal chilling effect without the limitations and disadvantages of the prior art.

SUMMARY OF THE INVENTION

The present invention is a molded or formed ceramic applicator head or applicator tip that is clad or plated with a suitable metal. The tip is designed to provide a relatively larger product-chilling effect to both the dose of cosmetic applied and to the user's skin in the application area when applying creams, lotions, treatment products, etc. The metal cladding provides a smooth, impervious and attractive surface to the molded ceramic material. The purpose of the invention is to provide an application device which will deliver the creams, lotions, treatment products, etc. such that the temperature of the product being delivered is lower than the temperature of the skin, and to provide a means of lowering the temperature of the skin by virtue of the thermal absorption capacity of the applicator head or tip.

DETAILED DESCRIPTION OF THE INVENTION

Figure 1:
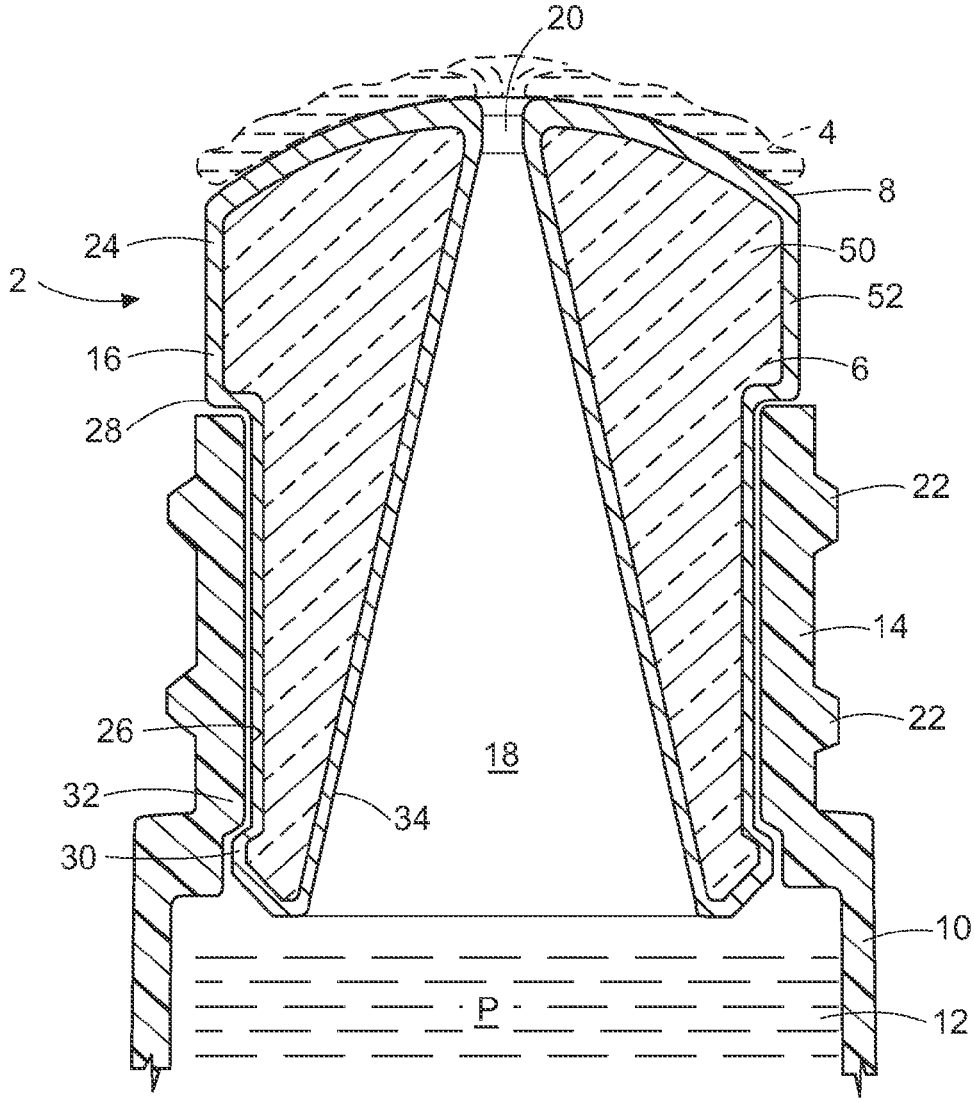
FIG. 1 is a cross-sectional view of an applicator tip of the present invention.
Figure 3:
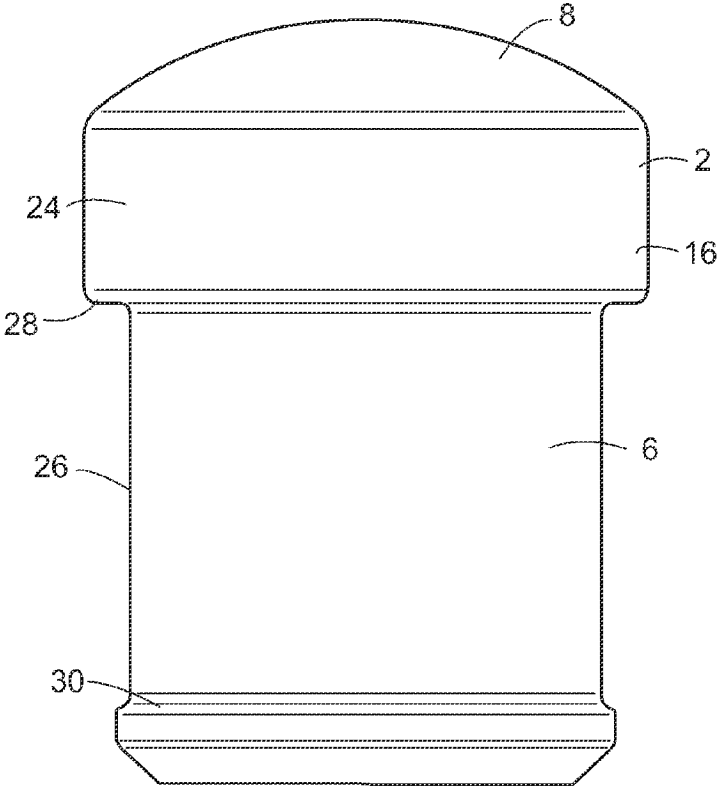
FIG. 3 is an elevation view of the embodiment of the applicator tip shown in FIGS. 1 and 2.
Figure 2:
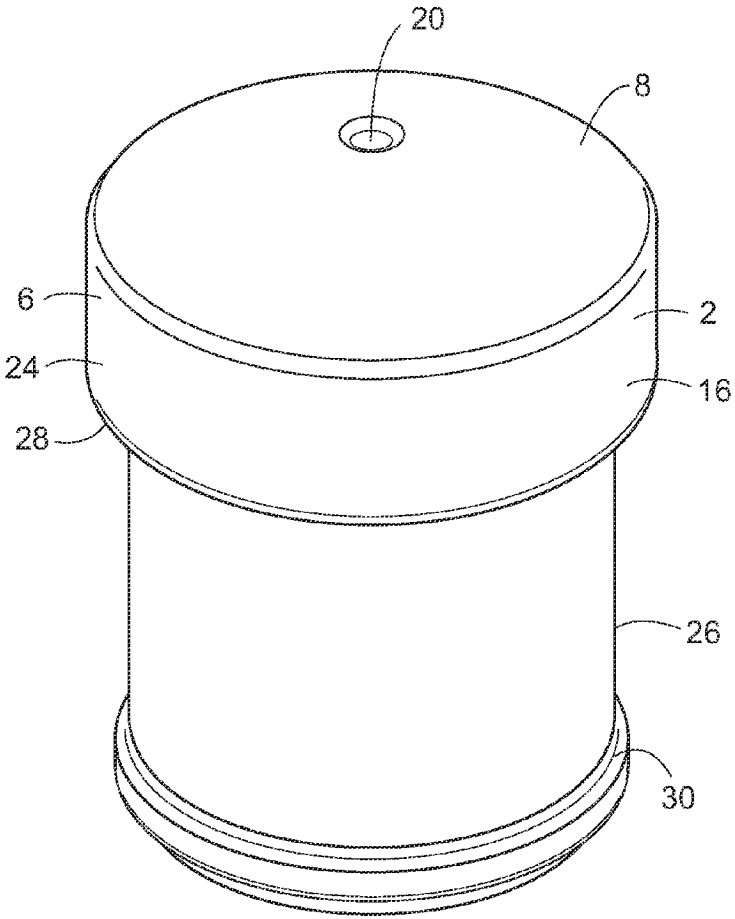
FIG. 2 is a perspective view of the embodiment of the applicator tip shown in FIG. 1.
Figure 4:
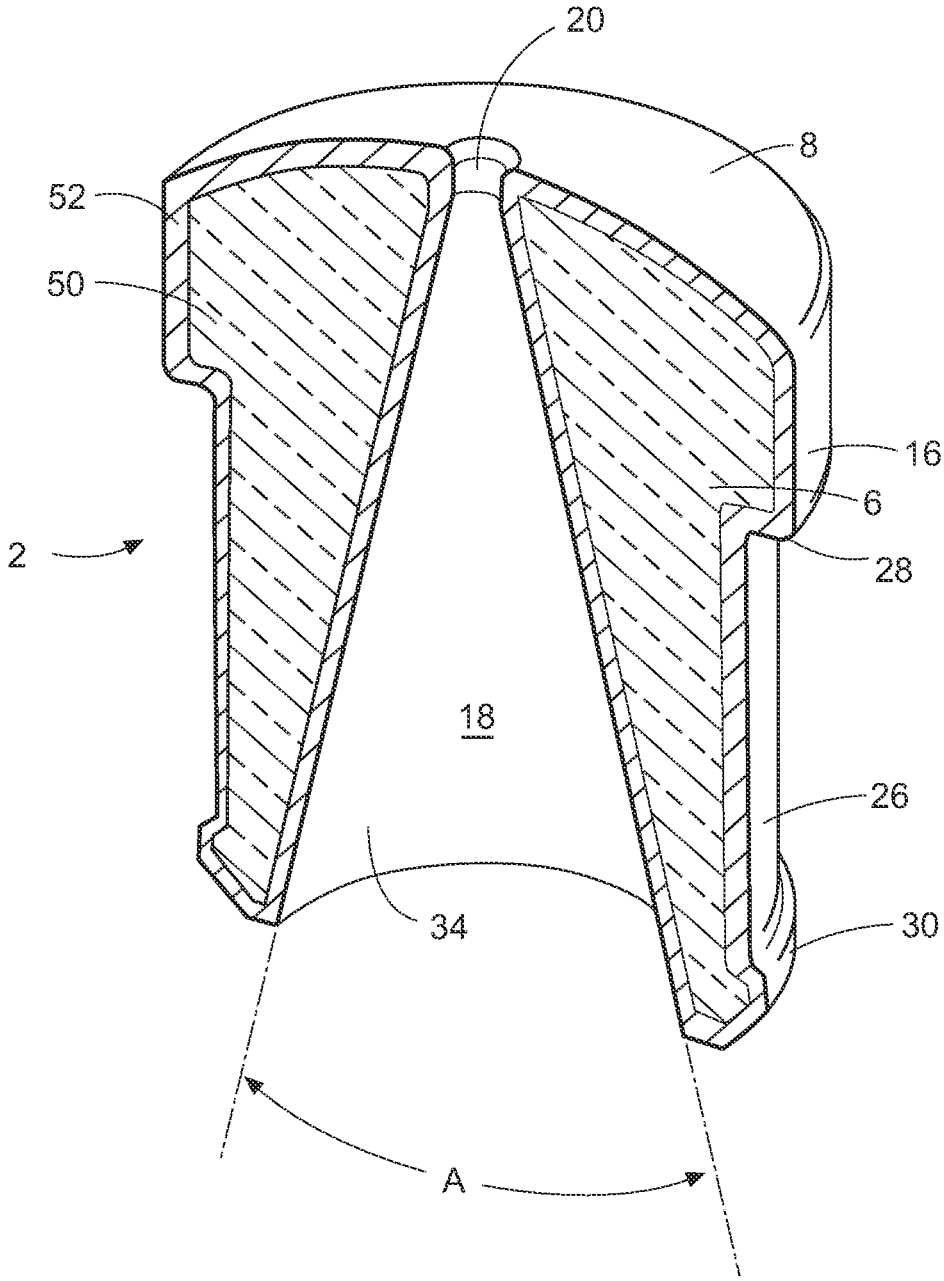
FIG. 4 is a cross-sectional and perspective view of the embodiment of the applicator tip shown in FIGS. 1-3.
Figure 5:
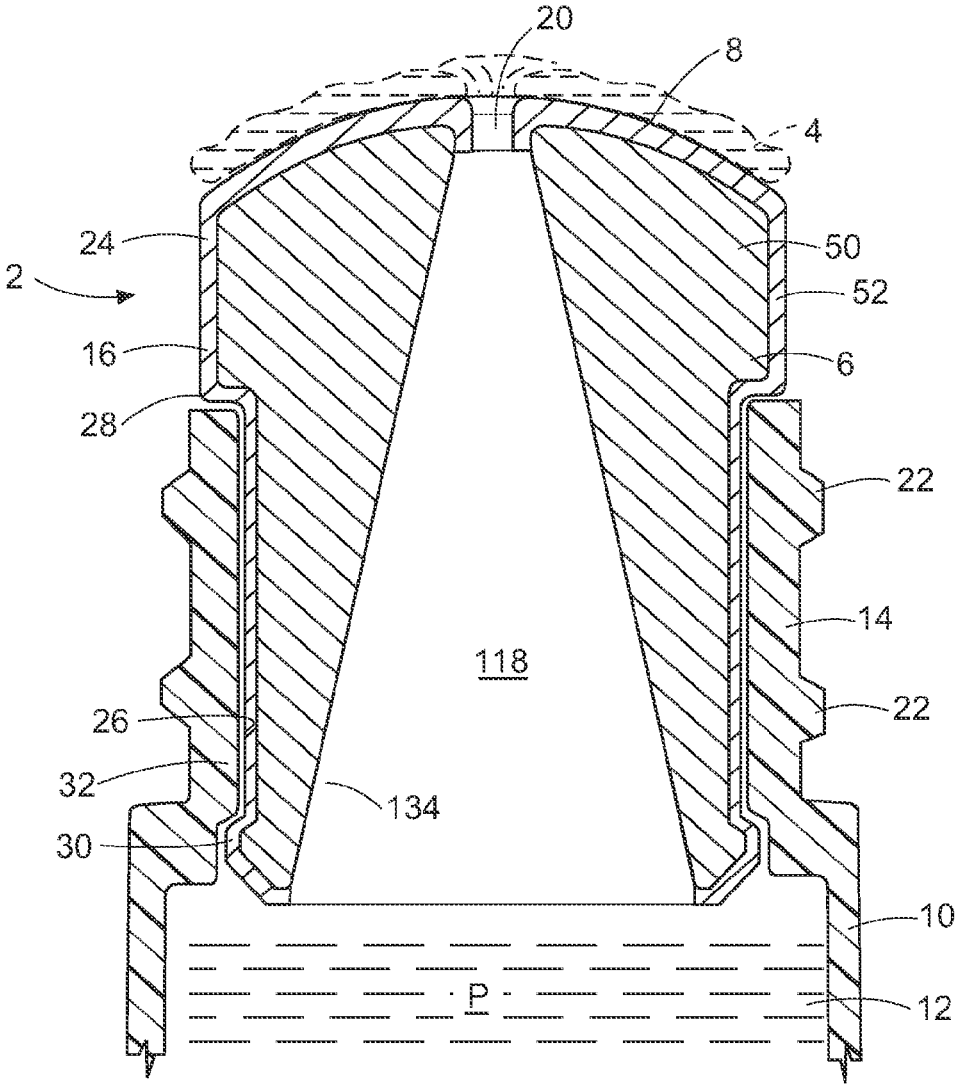
FIG. 5 is a cross-sectional view of a second embodiment of the applicator tip.

A cosmetic applicator tip of the present invention for applying a quantity of cosmetic product to an application area on the skin of a user is shown generally in FIGS. 1-5 designated by reference number 2. The terms "applicator tip" and "applicator head" are used interchangeably throughout this application to mean any structure or device provided for use in connection with a cosmetic product and that includes a surface adapted and intended to facilitate the loading, dispensing, transport and application of cosmetic product drawn from or expressed from the product reservoir and applied to the application area on a user. The applicator tip 2 may take the form of an applicator structure on an applicator device, such as, for example, a tube end dispenser 16 securely mounted in the neck 14 of a tube container 10 that defines a cosmetic product reservoir 12 (as shown in FIGS. 1 and 5). Alternatively, the applicator tip may take the form of a roller ball (not shown—e.g., like a roll-on deodorant applicator) secured in the neck of a tube or bottle container. As yet another alternative, the applicator tip may take the form of a spatula, spreader, spoon, etc., on a wand or handle (not shown).

The applicator tip 2 is intended for use with a cosmetic product P (FIG. 1) that is capable of conducting heat. The applicator tip 2 comprises a body 6 having a core 50 made of a ceramic material that is covered (i.e., coated, clad, plated, etc.) with a metal sheath 52. At least one applicator surface 8 is provided on the body 6. In the embodiment shown, a product delivery orifice 20 is provided in the applicator surface 8. An internal product delivery passage 18 in the body 6 provides fluid communication between the reservoir 12 and the orifice 20 to permit product P to flow or be expelled from the reservoir 12 through the orifice 20 to the applicator surface 8. The applicator surface 8 is adapted to receive from the reservoir 12 a pre-determined quantity 4 (represented schematically in broken lines) of cosmetic product P. The applicator tip 2, and in particular, the applicator surface 8, are also adapted to apply the quantity 4 of cosmetic product P to an application area on a user's skin, such as, for example, the puffy area of skin under a user's eye. The pre-determined quantity 4 can be approximately equal to a pre-selected, relatively uniform thickness of product P spread over the total area of the applicator surface 8. The quantity 4 of cosmetic product P has a thermal capacity (thermal capacity is also known as a heat capacity). The application area on the user's skin also has a thermal capacity. For the purposes of this invention, the combined thermal capacity of the quantity 4 of cosmetic and the thermal capacity of the application area is defined as the "first thermal capacity".

The body 6 is provided in a relatively large mass and made of materials sufficient to act as a thermal sink or a heat sink relative to the first thermal capacity of the quantity 4 of cosmetic product P and application area on the user's skin. As shown in the cross-sectional view in FIG. 1, the core 50 of the body 6 is formed from a relatively massive amount of ceramic material beneath the applicator surface 8 and about the orifice 20 and passage 18. The metal sheath 52 provides additional mass to the tip 2. This relatively massive amount of metal sheath and ceramic material and the type of material provides to the body 6 a second thermal capacity that is substantially greater than the first thermal capacity. Because the second thermal capacity of the body 6 is greater than the first thermal capacity of the quantity 4 of cosmetic product and application area on the user's skin, and because the applicator tip 2 will generally be at temperature close to an ambient air temperature, thermal energy in the form of heat will be drawn from the higher temperature of the user's skin to the applicator tip either through the quantity 4 of cosmetic product P or through direct contact of the applicator tip 2 to the user's skin. In other words, the second thermal capacity of the body 6 draws thermal energy in the form of heat from the first thermal capacity of the quantity of cosmetic product 4 and the application area on the user's skin such that a chilling sensation or effect is provided to the skin of the user. This chilling sensation or effect is believed to reduce, for example, the puffiness associated with the skin area below the eye. To further enhance the chilling effect and increase the heat drawing capacity of the applicator tip 2, prior to use, the applicator tip 2 can be chilled by, for example, refrigerating the package or dipping the applicator tip 2 into cool water or other liquid.

The cosmetic applicator tip 2 may be provided with means for attaching the body to a wand (not shown) or a package. For example, in FIG. 1, the package illustrated is a tube container 10 with a neck 12. The neck 12 includes external threads 22 for attaching a closure cap (not shown) over the applicator tip 2. The tip 2 has an upper portion 24 below which is a reduced diameter portion 26 defined between an upper annular shoulder 28 and lower annular shoulder 30. A reduced diameter portion 32 of neck 14 of tube container 10 is received in press fit in the reduced diameter portion 26 of the applicator 2 between the upper annular shoulder 28 and the lower annular shoulder 30. Other means for attaching the body to a wand or package may be provided, such as, for example, threaded attachment, bayonet attachment, rod-in-bore, bonded, welded, glued, interference or friction fit, etc.

The ratio of the first thermal capacity of the quantity of cosmetic product and the application area of the user's skin to the second thermal capacity of the applicator tip is in the range of at least 1:2, but preferably a much higher ratio, such as, for example 1:5 or 1:10 or 1:20 or greater. The greater the ratio, the more quickly the chilling effect will be felt and the effect will be felt by the user for a longer period of time.

The core 52 of the applicator tip 2 is made from a ceramic material. Preferably, the ceramic material is made by a high-temperature, fired-ceramic process, e.g., sintered. The parts are formed for example, by injection molding (e.g. colloidal slurry), thermoforming, dry pressing, gel casting, hot isostatic pressing, slip casting or other known molding methods. Alternatively, the parts may be made by jiggering or jolleying. The ceramic material preferably includes aluminum. More particularly, at least one component of the ceramic material is selected from aluminum oxide or aluminum nitride, or combinations thereof. Alternatively, the core 50 of the applicator tip 2 may be made at least in part from a silicon carbide.

Preferably, the ceramic material comprises concentrations ranging from 0.1% to 99.9% of the mass of the core 50. More preferably, the ceramic material comprises concentrations ranging from 94% to 99.9% of the mass of the core 50.

The metal sheath 52 comprises metal foil, sheet metal or metal otherwise fixed, formed or deposited on the surface of the core 50. For illustrative purposes, the metal sheath 52 is shown as being relatively thick. However, the metal sheath may be any suitable thickness. Preferably, the thickness of the metal sheath 52 is as thin as 1 angstrom and may be as thick as about 6 mm. For relatively expensive metals such as gold, silver or titanium, the thickness of the metal can be kept to an absolute minimum to reduce cost.

The metal selected for use in the sheath 52 should be compatible with cosmetic formulas and solvents. The metal should be corrosion resistant, particularly when exposed to cosmetics, and inert relative to cosmetics, e.g., the metal should not negatively impact the effectiveness, appearance or shelf-life of the cosmetic product. Metals suitable for use in the sheath 52 of the present invention include iridium, silver, gold, titanium, magnesium, chromium, copper, brass, stainless steel and aluminum. The sheath 52 may be made of a single metal, or combinations of metal (e.g., layers or laminates), or alloys. Silver is a preferred choice for the metal sheath 52 because silver has anti-microbial properties that may reduce the incidence of microbial contamination of the cosmetic product.

The metal sheath 52 is applied to the core 50 in the form of a plating, a coating, a foil or leaf, a sheet metal or other suitable form. The metal sheath 52 is applied by well known metal manufacturing means or processes, such as, for example, vapor deposition, plating (e.g., electro-plating or electro-deposition), gilding or metal leaf application (mechanical or chemical), coating, cladding, sheathing, metal deposition, soldering, sweating, etc. It may be formed mechanically (e.g., by stamping, pressing, machining, molding, cold forming, adhering, riveting, etc.), chemically (e.g., by electro-plating or electro-deposition) or physically (e.g., by over-molding, melt forming, soldering, hammering or heat forming) attached to the core. Preferably, the metal sheath 52 is applied by vapor deposition, electro-plating or electro-deposition.

The metal sheath 52 as illustrated in FIGS. 1 and 4 generally covers substantially all surfaces of the core 50, including the external surfaces, application surface 8, the edges of orifice 20 and the inwardly directed surface 34 of passage 18. However, all or some of the surfaces of the core 50 may be free of a metal sheath. For example, as illustrated in FIG. 5, the inwardly directed surface 134 of the passage 118 may be free of a metal sheath. In this case, the ceramic material of the core 50 of the body 6 may also include minerals or other compounds to improve the efficacy and/or the beneficial effect of the cosmetic product flowing through the passage 18 before being applied to the application area. The minerals may include tourmaline, jade, calcite, agate, etc. Further, a variety of other compounds, specifically natural and/or man-made, may be added to the ceramic material. The compounds and/or minerals are trapped or bonded within the structure of the ceramic material during the manufacturing process. These compounds and/or minerals may enhance the efficacy of the product being delivered and/or the beneficial effect of the ceramic component in delivery and application of the product. In use, formula being delivered would flow through the passage 118 illustrated in FIG. 5 in contact with inwardly directed surface 134 of passage 118. Because the ceramic material containing the compounds and/or minerals is exposed (i.e., not clad, plated or sheathed) at inwardly directed surface 134, the product passing through the passage would be exposed to the beneficial effect of the compounds and/or minerals in the ceramic material (e.g., the compounds and/or minerals in the ceramic material would leach or gradually dissolve into the product as the product contacts the exposed ceramic in the passage 118).

The conical configuration of passage 18, 118 delivers the product as cold as possible relative to the thermal mass of the device by providing an optimum contact-surface for maximum thermal-exchange between both the formula and the applicator and the skin and the applicator concurrently. The conical configuration of passage 18 facilitates such thermal transfer by providing greater surface area for cosmetic product to contact as it passes through the applicator tip 2. Thus, the passage has an inwardly directed surface 34, 134 through which the product is delivered which has an included draft angle A of no less than 1 degree, and no more than 45 degrees, which is believed to provide an optimum balance of thermal-absorption (heat absorption), product flow, and manufacturing requirements.

The invention is unique in several ways:

First, the metal sheath provides a smooth, impervious and attractive surface to the ceramic material of the core. The metal sheath can be polished or burnished to provide a luxurious appearance and feel to the package. Because the ceramic core is made utilizing manufacturing technology that provides a variety of component surface options, component material options, and component geometry options unavailable in applicators designed for similar purposes that are manufactured of metal, glass, etc., a variety of detailed shapes and configurations can be manufactured at a relatively low cost. With the metal sheath applied, these pieces will appear to be of a more expensive solid metal construction rather than the less expensive ceramic core construction. If a suitable metal, e.g., silver or gold, is selected for the sheath, applicator tips made according to the invention are free of any oxidation or corrosion issues common to some metals, and are inherently more shock resistant than comparable parts manufactured of glass.

By carefully selecting the composition and structure of the ceramic material, it can be specifically designed to provide a thermal capacity with a thermal coefficient and heat-absorption profile optimal for any given formula being delivered, thereby enhancing the performance of the formula to suit a particular formula or treatment regimen. This cannot be achieved with comparable metal or glass components used for similar purposes.

However, by making the same component according to the invention in a ceramic core with a metal sheath, the orifices and/or passages can be made as small in diameter as desired with no secondary operations, which provides fine-diameter orifices and/or passages with full-diameter contact with the thermal capacity of the ceramic, thereby increasing the chilling effect and delivering product which may be cooler than the product being stored in the container.

The advantage of this invention from a chemistry perspective is that it provides means of altering the applicator's composition and thermal capacity characteristics relative to a specific product delivery need or product-chemistry requirement. Comparable applicators comprised of metals and glass cannot be manipulated in this fashion, and subsequently the formulas they deliver must be designed around the characteristics of the applicator tip instead of the reverse, which is more desirable.

The advantage of the invention from a physical and manufacturing perspective is that the technology available to form ceramic parts provides a means to produce geometries, surface textures, and component details that are either unavailable in comparable solid metal and glass components, or require significant and complicated secondary operations to achieve the same effect. The metal sheath over the ceramic core provides the advantages of a solid metal tip at a significantly lower cost. The metal sheath provides a smooth, impervious and attractive surface to the ceramic core.

The technology can be used to manufacture applicators and application system components for the delivery of creams, lotions, skin treatment products, hair treatment products, color cosmetics, etc. It can also be used to manufacture tools and devices for the manipulation and doctoring of creams, lotions, skin treatment products, color cosmetics, etc. once they have been applied.

The applicator tip is comprised of a ceramic material core comprised of aluminum oxide, and/or aluminum nitride, and/or silicon carbide, possibly containing one or a combination of natural or man-made chemicals or minerals. The ceramic core is covered in a relatively thin metal sheath. The tip would be designed in a geometry which lends itself to a specific purpose relative to the formula being delivered (examples include an under-eye flow-through applicator or roller applicator designed for an under-eye formula; a hair-treatment applicator designed for a hair treatment formula, etc). The shape of the applicator is also designed in such a way to allow easy assembly to a suitable package or wand/handle without the need for additional components to retain it, e.g., to the package. This is facilitated by virtue of the processes inherent to the manufacture of ceramic materials. Such details are difficult or impossible to manufacture with other materials generally used for the same purpose (metals, glass, etc.) without the need for extensive post-processing and finishing.

The orifice or orifices and/or passage or passages of the applicator tip through which the product flows can be designed in various size diameters and positional arrays, and the application surface itself can me molded with a variety of textures and details to enhance the effectiveness of the delivery and the performance of the application. Such details are difficult or impossible to manufacture with other materials generally used for the same purpose (solid metals, glass, etc.) without the need for extensive post-processing and finishing.

The applicator would be made of high-temperature, fired-ceramic material (aluminum nitride, aluminum oxide, silicon carbide, etc.), with concentrations ranging from 0.1% to 99.9%, but preferably from 94% to 99.9% aluminum nitride, aluminum oxide, silicon carbide, etc.

It is understood that various modifications and changes in the specific form and construction of the various parts can be made without departing from the scope of the following claims.

What is claimed is:

1. A cosmetic applicator tip for applying a quantity of cosmetic product to an application area on the skin of a user, the quantity of cosmetic product and the application area combined having a first thermal capacity, the tip comprising:

a core made of a ceramic material in a mass sufficient to provide a second thermal capacity greater than the first thermal capacity;

a metal sheath covering at least a portion of the core; and at least one surface of the metal sheath adapted to receive the quantity of cosmetic product and apply it to the application area;

wherein the ratio of the first thermal capacity to the second thermal capacity is at least 1:2.

2. The cosmetic applicator tip of claim 1 further comprising means for attaching the tip to at least one of a wand and a package.

3. The cosmetic applicator tip of claim 1 wherein at least part of the ceramic material is aluminum.

4. The cosmetic applicator tip of claim 3 wherein the aluminum is selected from aluminum oxide and aluminum nitride or combinations thereof.

5. The cosmetic applicator tip of claim 1 wherein at least part of the ceramic material is silicon carbide.

6. The cosmetic applicator tip of claim 1 wherein the sheath is made from a metal selected from at least one of silver, iridium, gold, titanium, magnesium, chromium, aluminum, copper, brass and stainless steel.

7. The cosmetic applicator tip of claim 1 wherein the ceramic material comprises concentrations ranging from 0.1% to 99.9% of the mass of the core.

8. The cosmetic applicator tip of claim 1 wherein the ceramic material comprises concentrations ranging from 94% to 99.9% of the mass of the core.

9. The cosmetic applicator tip of claim 1 wherein the ceramic material further comprises at least one mineral.

10. The cosmetic applicator tip of claim 9 wherein the mineral is selected from at least one of tourmaline, jade, calcite and agate.

11. The cosmetic applicator tip of claim 1 wherein the core is made by a high-temperature, fired-ceramic process.

12. The cosmetic applicator tip of claim 1 wherein the applicator tip is adapted to be attached to a container that defines a cosmetic product reservoir, the applicator tip further comprising at least one product delivery orifice in the applicator surface, the orifice adapted to be in fluid communication with the product reservoir.

13. The cosmetic applicator tip of claim 12 further comprising a product delivery passage in the body between the delivery orifice and the product reservoir, the product delivery passage providing fluid communication from the product reservoir to the delivery orifice.

14. The cosmetic applicator tip of claim 13 wherein the product delivery passage has an inwardly directed surface through which product is delivered, the surface having an included draft angle of no less than 1 degree, and no more than 45 degrees.

15. The cosmetic applicator tip of claim 13 wherein the ceramic material further comprises at least one mineral selected from at least one of tourmaline, jade, calcite and agate, and at least a portion of the ceramic material of the core is exposed in the product delivery passage.

16. The cosmetic applicator tip of claim 1 wherein the tip is in the form of a roller ball.

17. The cosmetic applicator tip of claim 16 wherein the tip in the form of a roller ball is secured in a neck of a container.

18. The cosmetic applicator tip of claim 16 wherein the tip in the form of a roller ball is secured in a neck of a container selected from a tube and a bottle.

19. The cosmetic applicator tip of claim 1 wherein the applicator tip is in the form of one of a spatula, a spreader and a spoon.

20. The cosmetic applicator of claim 19 wherein the applicator tip is secured on at least one of a wand and a handle.

* * * * *